United States Patent [19]

Fehrer

[11] Patent Number: 4,799,294

[45] Date of Patent: Jan. 24, 1989

[54] APPARATUS FOR MAKING SLIVERS FROM A LAP

[76] Inventor: Ernst Fehrer, Auf der Gugl 28, A-4020 Linz, Austria

[21] Appl. No.: 147,885

[22] Filed: Jan. 25, 1988

[30] Foreign Application Priority Data

Jan. 30, 1987 [AT] Austria ..... 192/87
Apr. 9, 1987 [AT] Austria ..... 873/87

[51] Int. Cl.[4] ..... D01G 15/76

[52] U.S. Cl. ..... 19/99; 19/106 R; 19/301

[58] Field of Search ..... 19/99, 106, 301

[56] References Cited

U.S. PATENT DOCUMENTS 2,274,425 2/1942 Miller ..... 19/150
2,940,133 6/1960 Heritage ..... 19/301 X
2,986,780 6/1961 Bletzinger ..... 19/301 X
4,070,235 1/1978 Marshall ..... 19/301 X
4,534,086 8/1985 Fehrer ..... 19/99
4,583,267 4/1986 Fehrer ..... 19/99

FOREIGN PATENT DOCUMENTS 0379619 10/1986 Austria .

*Primary Examiner*—Louis K. Rimrodt
*Attorney, Agent, or Firm*—Kurt Kelman

[57] ABSTRACT

For use in the making of slivers from a lap, an apparatus is proposed which comprises a plurality of tooth-carrying carding drums (3, 4, 5, 6), which succeed each other in the direction of travel of the lap. Each carding drum (4, 5, 6) which succeeds another constitutes a worker roller for cooperating with the preceding carding drum (3, 4, 5). The fibers which fly from the carding drums (3, 4, 5 and 6) into ejection ducts (10) are deposited in the form of strips on a collecting surface (7), to which a vacuum is applied only in zones.

4 Claims, 3 Drawing Sheets

APPARATUS FOR MAKING SLIVERS FROM A LAP

BACKGROUND OF THE INVENTION

1. Field of the Invention

This invention relates to apparatus for making slivers from a lap, comprising a plurality of tooth-carrying carding drums, which closely succeed each other in the direction of travel of the lap and which rotate in the same sense, wherein each carding drum which succeeds another in the direction of travel of the lap constitutes a worker roller for cooperating with the preceding carding drum, ejection ducts are provided, which extend from respective triangular spaces defined by adjacent carding drums and serve to conduct lap fibers which fly under centrifugal force from the carding drums, and an air-permeable collecting surface is provided, which is continuously moved and to which a vacuum is applied and which serves to receive the fibers from said ducts.

2. Description of the Prior Art

When rovings are to be made from a lap, the lap is initially carded by means of at least one tooth carrying carding drum and is subsequently divided into a plurality of slivers, which are then combined to form rovings. For this reason the uniformity of said rovings will depend on the uniformity of the slivers and the uniformity of the slivers will not be satisfactory when slivers are made at a high throughput rate.

It is known from Austrian Patent Specification No. 379,619 that in the making of a random-laid nonwoven web an excellent opening of the lap and a uniform deposition of the fibers on a collecting surface, to which a vacuum is applied, can be achieved in that a plurality of carding drums rotating in the same sense are arranged in close succession in such a manner that each carding drum which succeeds another constitutes a worker roller for combing the fibrous material that is being supplied by the preceding carding drum and those fibers which have not been combed out are thrown off below the carding drums onto the collecting surface immediately after the combing operation. As a result, the lap is divided into a plurality of partial streams of fibers, which are successively applied to the collecting surface and which may have a low fiber density even if the throughput rate of material through the apparatus is relatively high. Such a low fiber density and the application of the fibers in a plurality of layers are essential for the making of a highly uniform web.

From U.S. Pat. No. 2,274,425 it is also known that the coherence of the fibrous structure of rovings that have been made from a nonwoven web or from fibers which have been deposited on a conveyor belt after a free flight can be improved in that the conveyor belt which receives the fibers or the nonwoven web is provided with suction zones, which are inclined with respect to the direction of travel of the conveyor belt, and in that air is blown through the conveyor belt between said suction zones, so that fibers are blown off from and sucked onto the conveyor belt in respective zones and the fibers are thus divided into rovings. Owing to the inclination of the suction zones relative to the direction of conveyance of the conveyor belt said rovings are subjected to a transverse force and to a torque. Said torque is intended to consolidate the fibrous structure of each roving. That known apparatus had the disadvantage that the distribution of the fibers within the several rovings is subjected to substantial disturbing influences so that highly uniform rovings cannot be made. Besides, the throughput rate which can be achieved is limited.

To permit the making of drawn sliver having the high uniformity which is required for a subsequent spinning of drawn sliver, a plurality of slivers are supplied to a common drawing frame, in which a drawn sliver is formed from the individual slivers. That drawn sliver is then deposited by means of revolving disc into a can. Because the known apparatus for making slivers have a much higher throughput rate than drawing frames, the slivers must first be deposited in cans and must then be supplied to the drawing frame, in which a drawn sliver is made. When the supplies of sliver in the respective can have been consumed, the empty cans must be replaced by full cans so that the making of drawn sliver will have to be interrupted even if the replacement of cans is automatically performed. Besides, such automatic replacement involves a high structural expenditure.

SUMMARY OF THE INVENTION

For this reason it is an object of the invention to ensure in the making of slivers a deposition of fibers with the high uniformity which can be achieved in the making of random-laid nonwoven fabrics and to accomplish this at a throughout rate which is sufficient to permit a immediate further processing of the slivers to form drawn sliver without a need for intermediate storage.

In an apparatus of the kind described first hereinbefore the object set forth is accomplished in accordance with the invention in that a vacuum is applied to the collecting surface adjacent to the ejection ducts only in suction zones having the same width as the slivers to be made and in that the suction zones are arranged one beside the other adjacent to respective ejection ducts and are spaced apart transversely to the direction of travel of the collecting surface.

Because a vacuum is applied to the collecting surface in zones adjacent to the ejection ducts, the fibers which have been thrown off will not uniformly be distributed throughout the width of the collecting surface but will be deposited as strips corresponding to the suction zones so that the several slivers will be directly formed and a subsequent division of a nonwoven web into a plurality of slivers is no longer required. Because the advantages which are afforded by an opening of a lap into a plurality of partial streams, which are consecutively applied to the collecting surface after a free flight will be obtained also when fibers are deposited in strips on the collecting surface, the several slivers will be highly uniform even when they are made at a high throughput rate. The zonewise application of a vacuum to the collecting surface is required for a division of each partial stream of fibers which have been thrown off and will not adversely effect the uniform deposition of fibers in each suction zone because under the action of the stream of sucked air the fibers are moved to the collecting surface and are retained on said surface. Any fibers which impinge on the collecting surface in one of the intermediate zones to which no vacuum is applied will be sucked to one or the other of the adjacent suction zones so that a distinct separation of the slivers will be achieved even if the suction zones are only closely spaced apart. The random distribution of the fibers in the structure of each sliver will afford the advantage that the rovings formed each from a plurality of slivers can more easily be opened into individual fibers.

To form the several suction zones adjacent to the ejection ducts, the suction zones may be separated from each other by air-impermeable separating bars, which adjoin the collecting surface. Adjacent to said intermediate bars, the collecting surface is covered against a stream of sucked air. Alternatively, a zonewise application of a vacuum to the collecting surface can be achieved in that the suction zones are separated by air-impermeable portions of the collecting surface. In that embodiment, regions to which no vacuum is applied are also provided between the suction zones.

Because a high throughput rate can be achieved, the apparatus in accordance with the invention can be used to make sliver at a desired weight rate and at a high delivery velocity. As a result, in plants for making drawn sliver it will be sufficient to provide a conventional drawing frame immediately behind the apparatus in accordance with the invention for making slivers. An intermediate storage of the slivers in cans is no longer required and the disadvantages involved in a replacement of cans are eliminated.

DETAILED DESCRIPTION OF THE PREFERRED EMBODIMENTS

Figure 1:
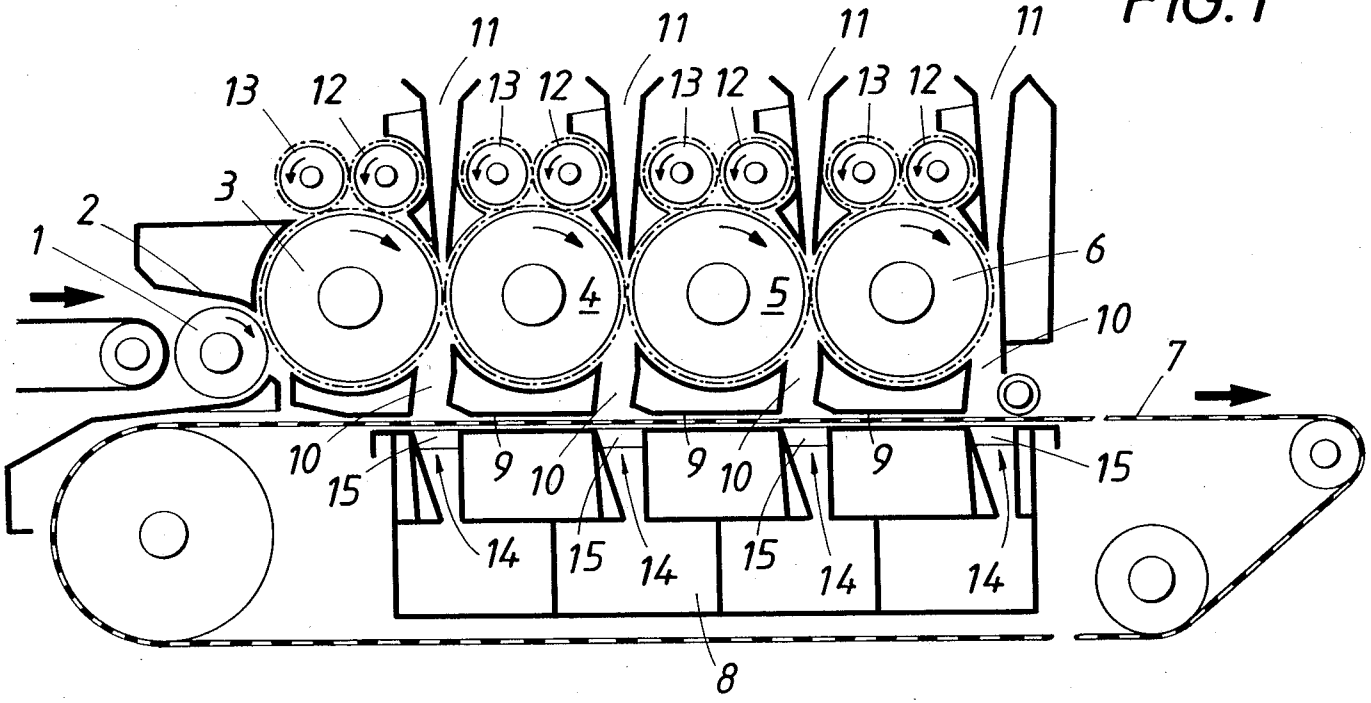
FIG. 1 is a diagrammatic longitudinal sectional view showing an apparatus in accordance with the invention for making slivers from a lap.

The invention is illustrated by way of example on the drawing.

In the illustrated apparatus for making slivers, a lap is supplied in conventional manner through a feeder consisting of a feed roller 1 and a trough-shaped feed deck 2 to a plurality of carding drums, 3, 4, 5 and 6, which rotate in the same sense and are juxtaposed and closely spaced apart. An airpermeable collecting surface 7, which is constituted by a revolving conveyor belt, extends under said carding drums 3, 4, 5 and 6 and is subjected to a vacuum by means of a suction box 8. The carding drums 3, 4, 5 and 6 are shielded from the collecting surface 7 by covers 9. Ejection ducts 10 are provided between said covers 9 and extnd into the triangular spaces between the carding drums. On the side on which the collecting surface 7 arrives and on the side on which the collecting surface 7 departs, said ejection ducts 10 have guide walls, which contact the fibrous layers which have already been deposited. As a result, the ejection ducts 10 are sealed adjacent to the collecting surface 7 against disturbing influences of lateral air currents.

To permit a matching of the velocity of flow of the air in the ejection ducts 10 to the velocity at which the fibers are thrown off and to ensure that the fibers detaching from the carding drums 3, 4, 5 and 6 will be entrained by an air stream, blast nozzles 11 are provided on that side of the carding drums 3, 4, 5 and 6 which is remote from the collecting surface 7 and deliver blasts of air through the throats between the carding drums into the ejection ducts 10.

Because the carding drums 3, 4, 5 and 6 are arranged in close succession, each carding drum which succeeds another constitutes a worker roller cooperating with the preceding carding drum. As a result, the lap that is supplied to the carding drum 3 is partly combed out by the carding drum 4, which rotates in the same sense, and that fibrous material which has not been taken by the carding drum 4 is thrown off into the ejection duct 10 between the carding drums 3 and 4 and is applied to the collecting surface 7. The fibrous material which is carried forward by the carding drum 4 is divided adjacent to the carding drum 5 into a partial stream that is to be ejected and into a partial stream that is to be carried forward and is divided once more by the carding drum 6. As a result, the fibrous layer to be deposited on the collecting surface 7 is built up from a plurality of partial streams of fibers each of which has a relatively low fiber density.

To permit the lap to be opened to a higher degree, a worker roller 12 and a clearer roller 13 are associated with each of the carding drums 3, 4, 5 and 6 and are disposed on that side of its periphery which faces away from the collecting surface 7. The worker rollers 12 comb off part of the fibers which cover each carding drum. The fibers which have been taken by the worker rollers 12 are taken over and returned to the carding drums by the clearer rollers 13. As a result, the fibers which cover each carding drum are opened even before they are delivered to the succeeding carding drum and such opening will promote the uniformity of the distribution of fibers.

Figure 2:
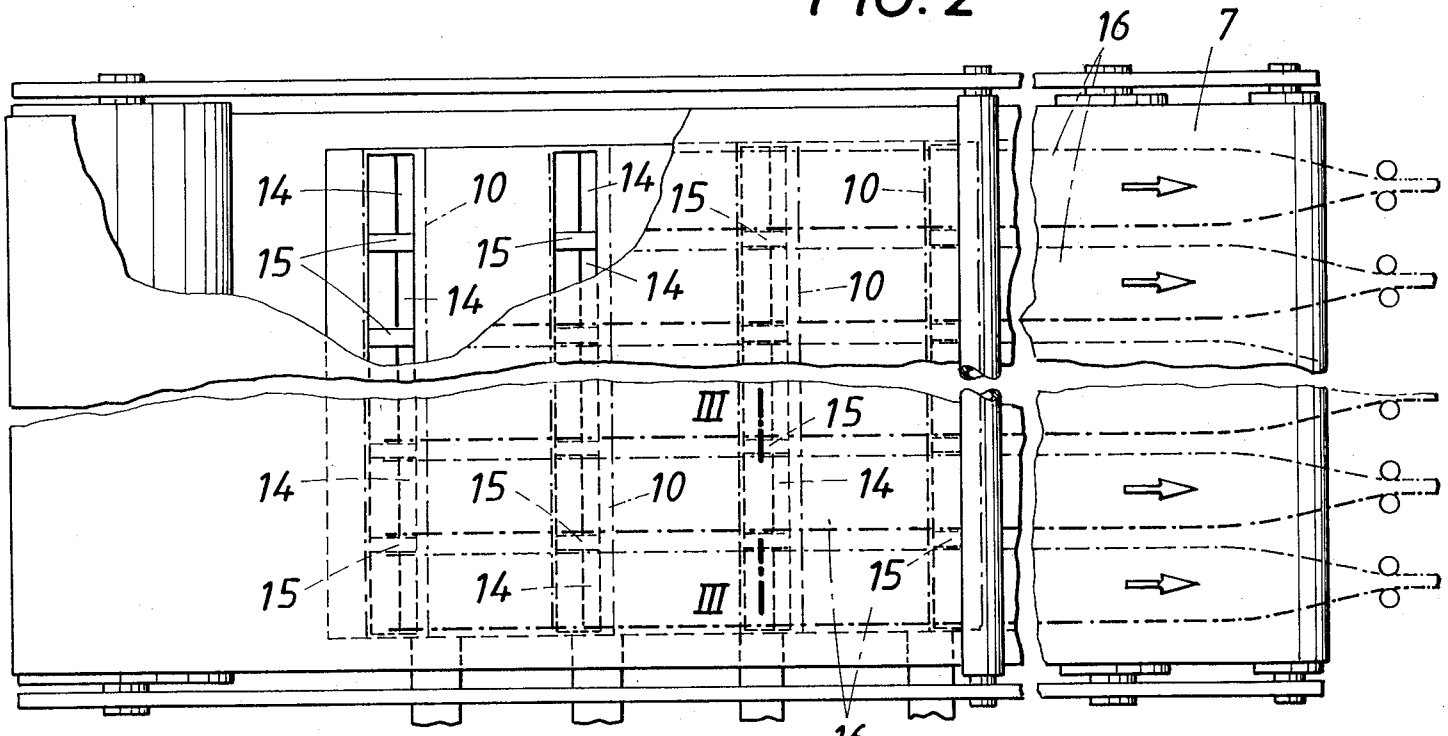
FIG. 2 is a top plan view, partly broken away, showing said apparatus in a view taken on the collecting surface.
Figure 3:
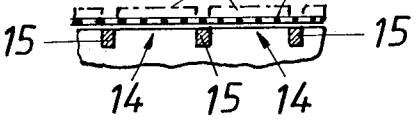
FIG. 3 is an enlarged sectional view taken on line III—III in FIG. 2.

To ensure that the fibers will be deposited in strips on the collecting surface 7 so that a plurality of slivers will be formed, a vacuum is applied to the collecting surface 7 only in zones adjacent to the ejection ducts. The outlet portion of the ejection ducts 10 is indicated in phantom in Figure 2. The suction zones 14 are spaced apart transversely to the direction of movement of the collecting surface 7. In accordance with FIGS. 1 and 3 the suction zones 14 are separated from each other by air-impermeable intermediate bars 15. Which adjoin the collecting surface 7 on that side of the latter which is remote from the ejection ducts 10. As a result, the fibers which have been thrown off the carding drums 3, 4, 5 and 6 are sucked to the collecting surface 7 only in the suction zones 14 between the separating bars 15 so that the fibers are deposited in strips to form highly uniform slivers 16.

Figure 4:
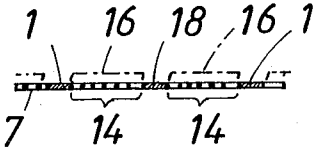
FIG. 4 is a view that is similar to FIG. 3 and shows a modified design.

In an alternative embodiment, the separated suction zones 14 adjacent to respective ejection ducts 10 may be obtained in accordance with FIG. 4 in that the collecting surface 7 is not air-permeable throughout its width and covered in strip-shaped areas against the stream of sucked air but the air-permeable strip-shaped portions 17 are constituted by the collecting surface itself so that the fibers will also be deposited in the form of slivers 16.

Figure 5:
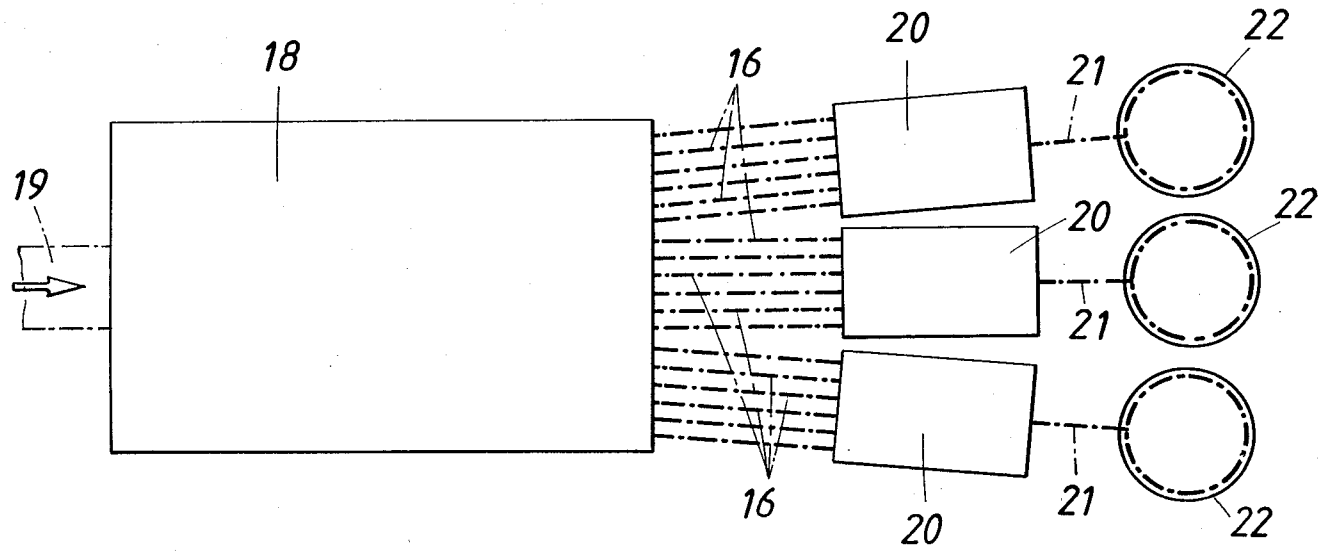
FIG. 5 is a diagrammatic block diagram showing a plant for making a drawn sliver with the aid of the apparatus in accordance with the invention.

As is apparent from FIG. 5, an apparatus 18 in accordance with the invention is operated to make slivers from a lap 19. A plurality of slivers 16 are made, which are spaced apart as they leave the appartus 18 and which are combined in sets, which are fed to respective drawing frames 20. Because the slivers 16 supplied to each drawing frame 20 are jointly drawn, a drawn sliver 21 is obtaianed, which in the illustrative embodiment is deposited in cans 22. As the drawing frames 20 directly succeed the apparatus 18, an intermediate storage of the slivers 16 in cans is not required and the drawing frames 20 are continuously fed with slivers 16 so that the drawn slivers 21 can be made in a continuous operation.

I claim:

1. An apparatus for making slivers having a predetermined width from a lap, comprising lap-feeding means for feeding a lap in a predetermined direction of travel, a plurality of carding drums, which are closely laterally spaced apart in said direction of travel so that downwardly flaring triangular spaces are defined by the peripheral surfaces of adjacent ones of said carding drums and each of said carding drums which succeds another constitutes a worker roller for cooperating with a preceding one of said carding drums, said carding drums being operable to rotate in the same sense so that fibers are received by said carding drums from said lap-feeding means and said carding drums are adapted to throw fibers into said triangular spaces, said apparatus further comprising collecting means forming an air-permeable collecting surface, which extends below said carding drums, said collecting means being operable to continuously move said collecting surface in said direction of travel, and ejection ducts communicating with respective ones of said triangular spaces and leading to said collecting surface, the improvement residing in that a vacuum is applied to said collecting surface adjacent to said ejection ducts only in discrete suction zones, which are spaced apart transversely to said direction of travel and have a width each which is equal to said predetermined width.

2. The improvement set forth in claim 1, wherein air-impermeable separating bars adjoin said collecting surface between adjacent ones of said suction zones.

3. The improvement set forth in claim 1, wherein said collecting surface comprises air-impermeable strips between adjacent ones of said suction zones.

4. In a plant for making drawn sliver from a lap, comprising apparatus for making a plurality of slivers to be incorporated in said drawn sliver, which apparatus comprises lap-feeding means for feeding a lap in a predetermined direction of travel, a plurality of carding drums, which are closely laterally spaced apart in said direction of travel so that downwardly flaring triangular spaces are defined by the peripheral surfaces of adjacent ones of said carding drums and each of said carding drums which succeeds another constitutes a worker roller for cooperating with a preceding one of said carding drums, said carding drums being operable to rotate in the same sense so that fibers are received by said carding drums from said lap-feeding means and said carding drums are adapted to throw fibers into said triangular spaces, said apparatus further comprising collecting means forming an air-permeable collecting surface, which extends below said carding drums, said collecting means being operable to continuously move said collecting surface in said direction of travel, and ejection ducts communicating with respective ones of said triangular spaces and leading to said collecting surface, the improvement residing in that a vacuum is applied to said collecting surface adjacent to said ejection ducts only in discrete suction zones, which are spaced apart transversely to said direction of travel and have a width each which is equal to said predetermined width, whereby a sliver is formed on said collecting surface in each of said zones and is delivered from said collecting surface, and said plant further comprises a drawing frame for directly receiving a plurality of said slivers from said collecting surface.

* * * * *